US005084732A

United States Patent [19]

Tsaur et al.

[11] Patent Number: 5,084,732

[45] Date of Patent: Jan. 28, 1992

[54] BOOK COPYING MACHINE

[76] Inventors: Ron H. Tsaur; Hsien T. Fu, both of 9040 Telstar Ave. Suite 101, El Monte, Calif. 91731

[21] Appl. No.: 550,281

[22] Filed: Jul. 9, 1990

[51] Int. Cl.[5] ..... G03G 21/00

[52] U.S. Cl. ..... 355/230; 355/25; 355/75

[58] Field of Search ..... 355/25, 75, 230, 234

[56] References Cited

U.S. PATENT DOCUMENTS

| | | | |
|---|---|---|---|
| 3,630,612 | 12/1971 | Le Hovec | 355/25 X |
| 3,635,555 | 1/1972 | Kurahashi et al. | 355/75 X |
| 3,635,557 | 1/1972 | Alderton | 355/25 X |
| 4,386,846 | 6/1983 | Clark et al. | 355/25 |

*Primary Examiner*—A. T. Grimley

*Assistant Examiner*—Nestor R. Ramirez

*Attorney, Agent, or Firm*—Asian Pacific International Patent and Trademark Office

[57] ABSTRACT

A book copying machine comprises a housing covered with a movable exposure glass at the top and having set therein a microprocessor, a copying camera system, a carbon powder feeding and image setting device, a paper turn-over device and a return delivery device. The movable exposure glass comprises a transverse wedge portion in the middle which can be driven to displace by a driving device so as to fit the surface curvature of the fold of a book. Through the control of the microprocessor to coordinate the parts of the machine, page editing is simply achieved by piling up the duplicated sheets of paper which are folded up respectively.

6 Claims, 15 Drawing Sheets

BOOK COPYING MACHINE

BACKGROUND OF THE INVENTION

The present invention is related to copy machines and more particularly to a book copying machine for copying and for page editing.

The copying machine is a device specifically designed for duplicating paper document. When certain pages of a book are to be duplicated through a copying machine, the drawings and letters near folding edges may be deformed or darkened since they could not be set to closely contact with the copying glass plate of a copying machine and are generally deviated from the focus of the copying camera. Further, when the both pages of a sheet of paper document are to be duplicated through a copying machine, two blank sheets of paper are generally used. This method is a waste of money since it doubles the consumption of paper. If the both sides of a blank sheet of paper are fully utilized for duplicating the both pages of a book blade, page editing is an another problem to settle.

SUMMARY OF THE INVENTION

The present invention has been accomplished under the circumstances in view. It is an object of the present invention to provide a book copying machine which achieves page editing operation while copying.

It is another object of the present invention to provide a book copying machine which can be conveniently efficiently used for copying a book by moving an exposure glass horizontally and vertically permitting the wedge portion thereof to fit the fold of the book blades mounted thereon for quality copying.

It is still another object of the present invention to provide a book copying machine which does not damage book blades when a book is mounted thereon in an opened condition for copying.

It is a yet further object of the present invention to provide a book copying machine which performs book copying operation in such an order that all the pages of the duplicated sheets are set in continuous sequence after the duplicated sheets are folded up and piled together.

According to the present invention, a book copying machine comprises a movable exposure glass having a transverse wedge portion in the middle which can be driven to displace by a servo motor through a V-shaped guide channel so as to fit the surface curvature of the fold of a book. Thus, the image on the folding area of every page of a book can be accurately clearly duplicated.

The page editing function of the present invention is achieved by means of a paper turn-over device which turns a sheet of paper for next copying operation after one side of which is duplicated. After the completely duplicated sheets of paper are respectively folded up and piled up together, a set of copies arranged in proper order is obtained.

BRIEF DESCRIPTION OF THE DRAWINGS

The present invention will now be described by way of example with reference to the annexed drawings, in which.

DETAILED DESCRIPTION OF THE PREFERRED EMBODIMENT

Figure 1:
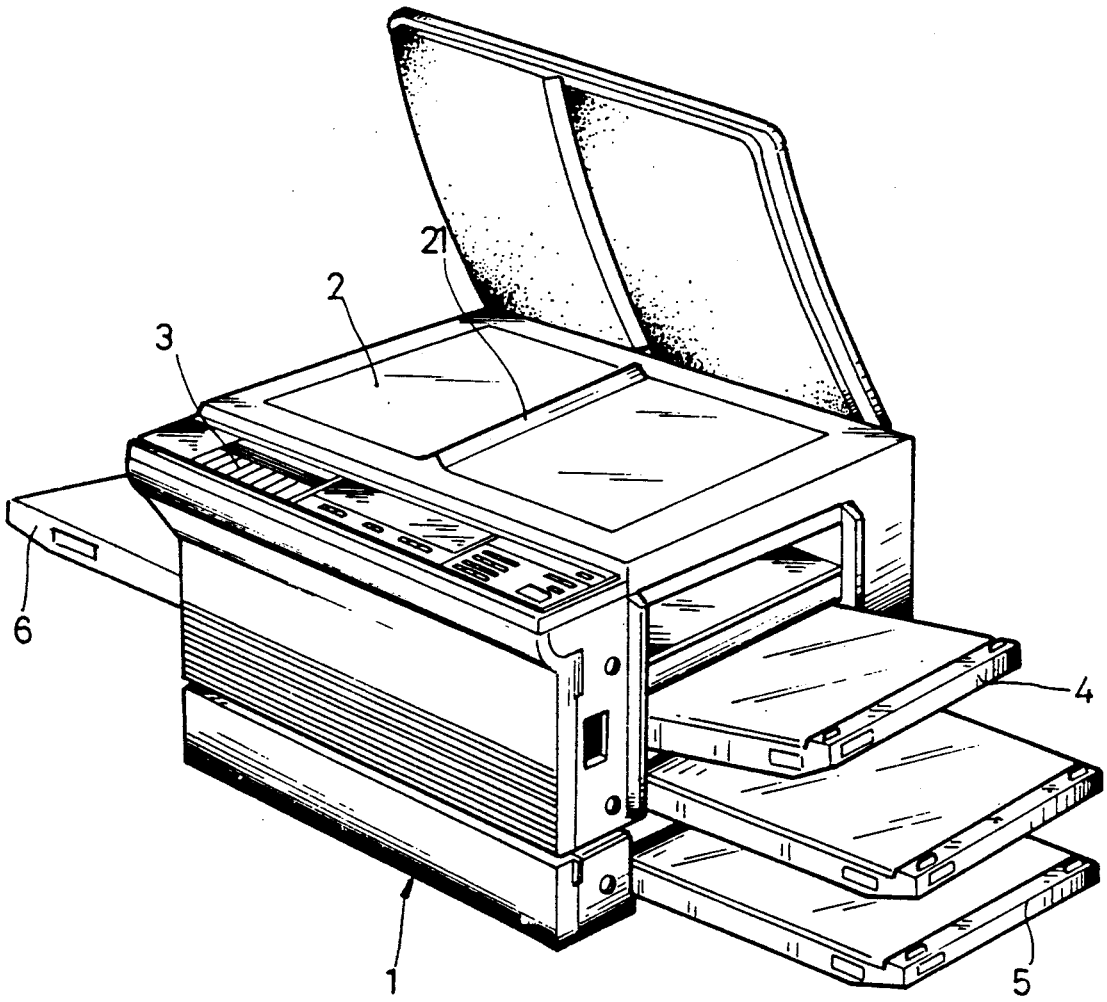
FIG. 1 is a perspective view of a book copying machine embodying the present invention.

Referring to FIG. 1, there is illustrated a book copying machine embodying the present invention and generally comprising a housing 1, an exposure glass 2, a control panel 3 and three paper cassettes 4, 5 and 6 (called in proper order a first paper cassette, a second paper cassette and a third paper cassette).

Figure 5A:
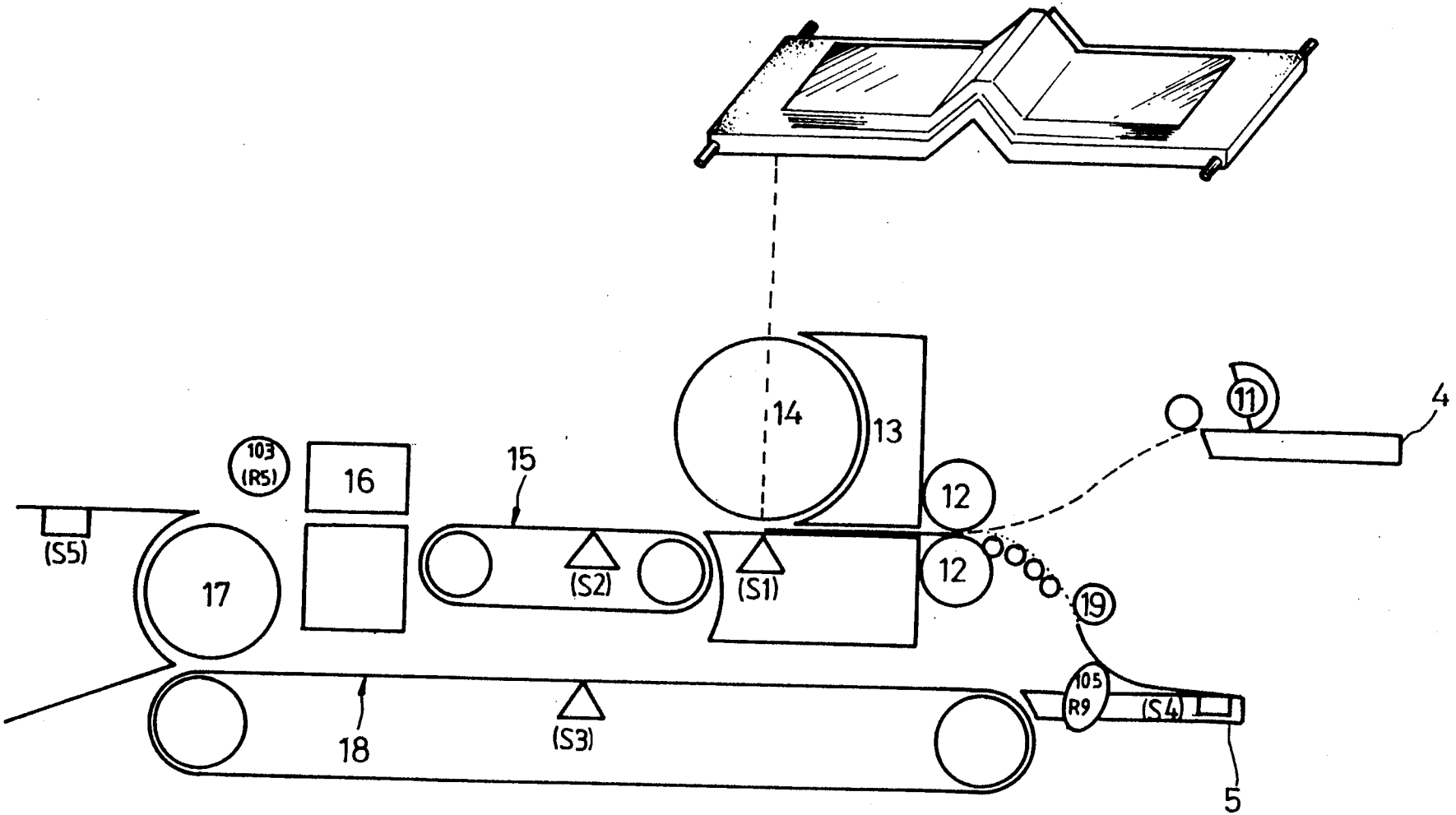
FIGS. 5*a*–5*f* illustrate the operational procedures thereof.

The housing 1 has an internal structure (see FIG. 5*a*) comprising the following parts:

1. A device for receiving blank sheets of paper from the first paper cassette 4, which is a cam roller 11;
2. A paper receiving and registration device which comprises a carbon power feeding and image setting device having an upper and lower rollers 12, a toner cartridge 13, a carbon power roller 14, a sensor S1, a belt conveyer 15 and a heat pressure device 16 for image setting;
3. A paper turn-over device comprising a cam 103, a reactor R5 and a roller 17;
4. A return delivery device comprising a belt conveyer, sensors S3 and S4, a stop wheel 105, a reactor R9 and rollers 19; and
5. A copying camera and a light source (not shown) matching the exposure glass 2 for operation.

Figures 8A, 8B, 8C, 8D, 8E, 8F:
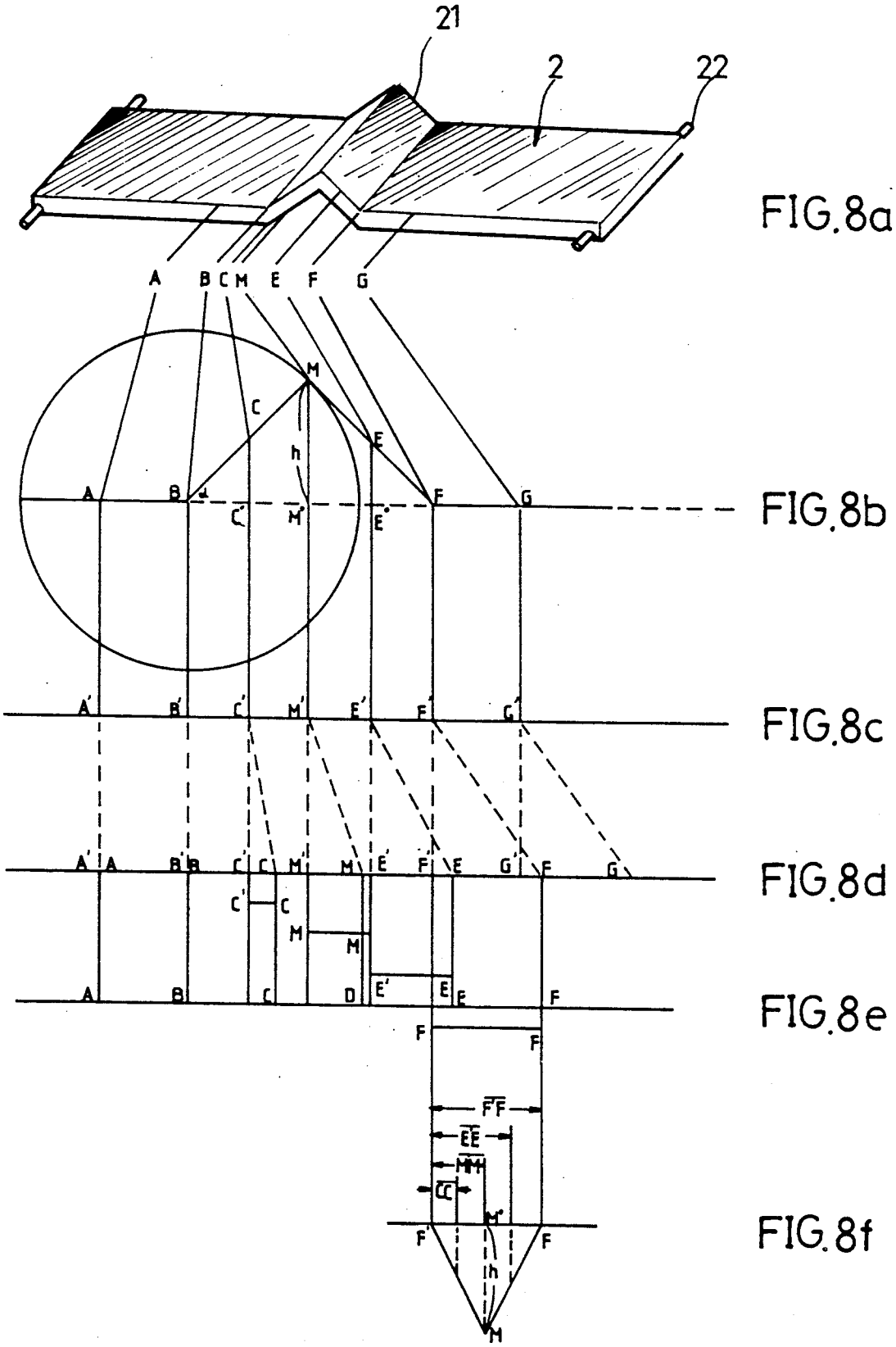
FIGS. 8*a*–8*f* are schematic drawings illustrating the graphic track of projection according to the present invention.
Figure 10:
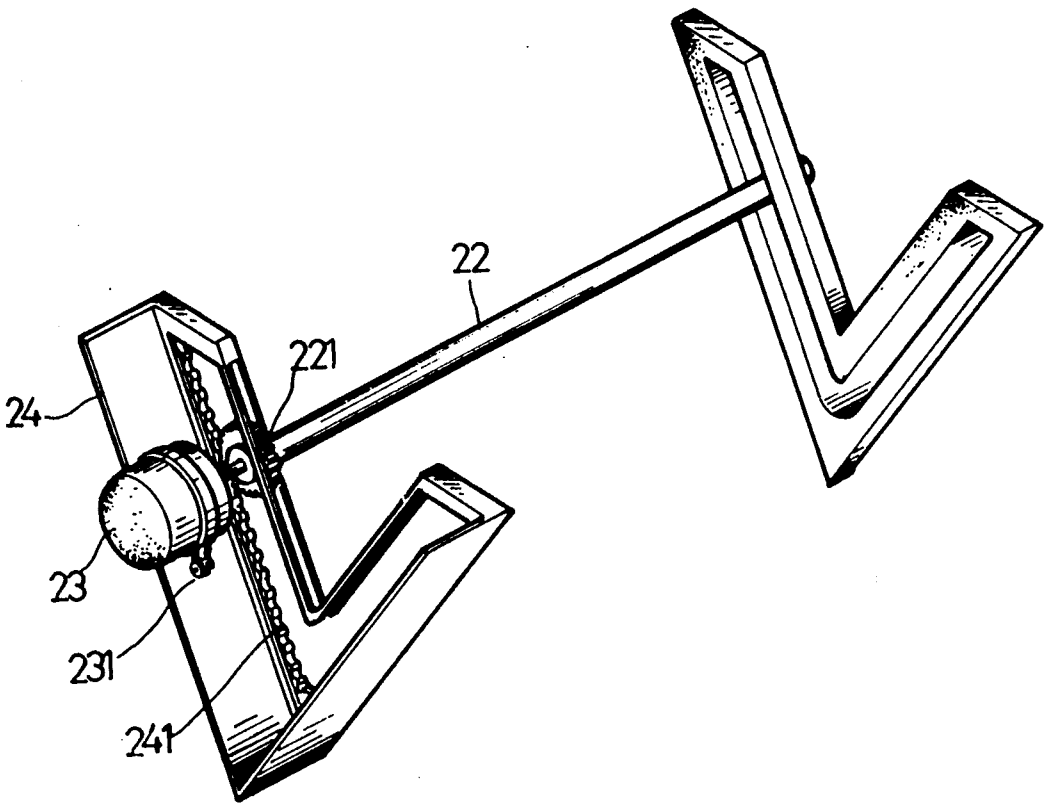
FIG. 10 is a perspective view of the V-shaped guide channel.

Referring to FIG. 8*a*, the exposure glass 2 is one part of the machine which is directly in contact with the surface of the pages of a book to be duplicated and comprises a transverse wedge portion 21 in the middle, two opposite side links 22 and V-shaped guide channels (see FIG. 10).

Figure 2:
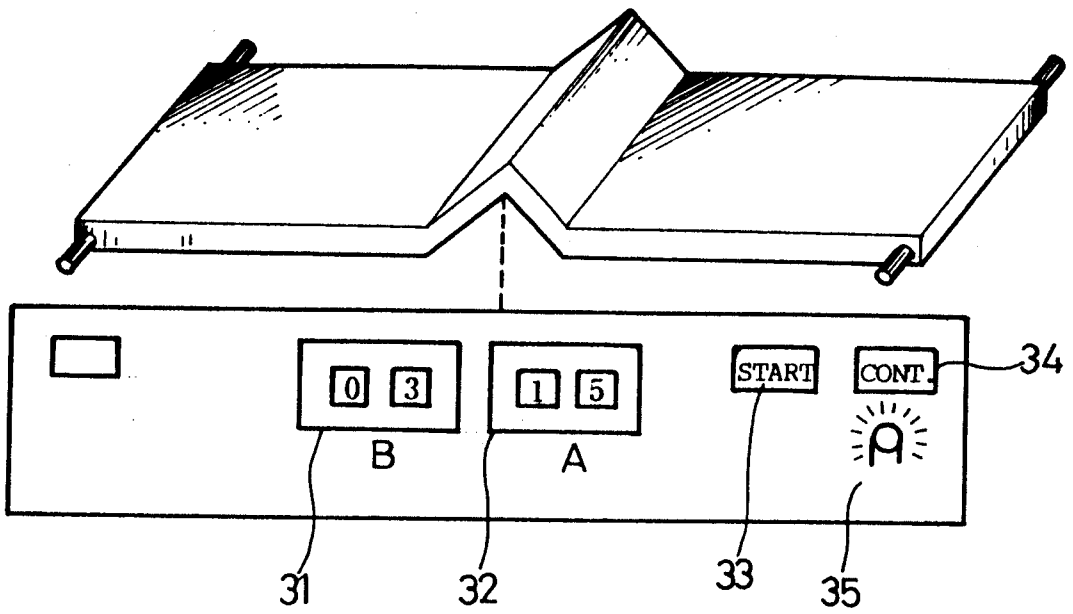
FIG. 2 is a shematic drawing of the control panel thereof.
Figure 3:
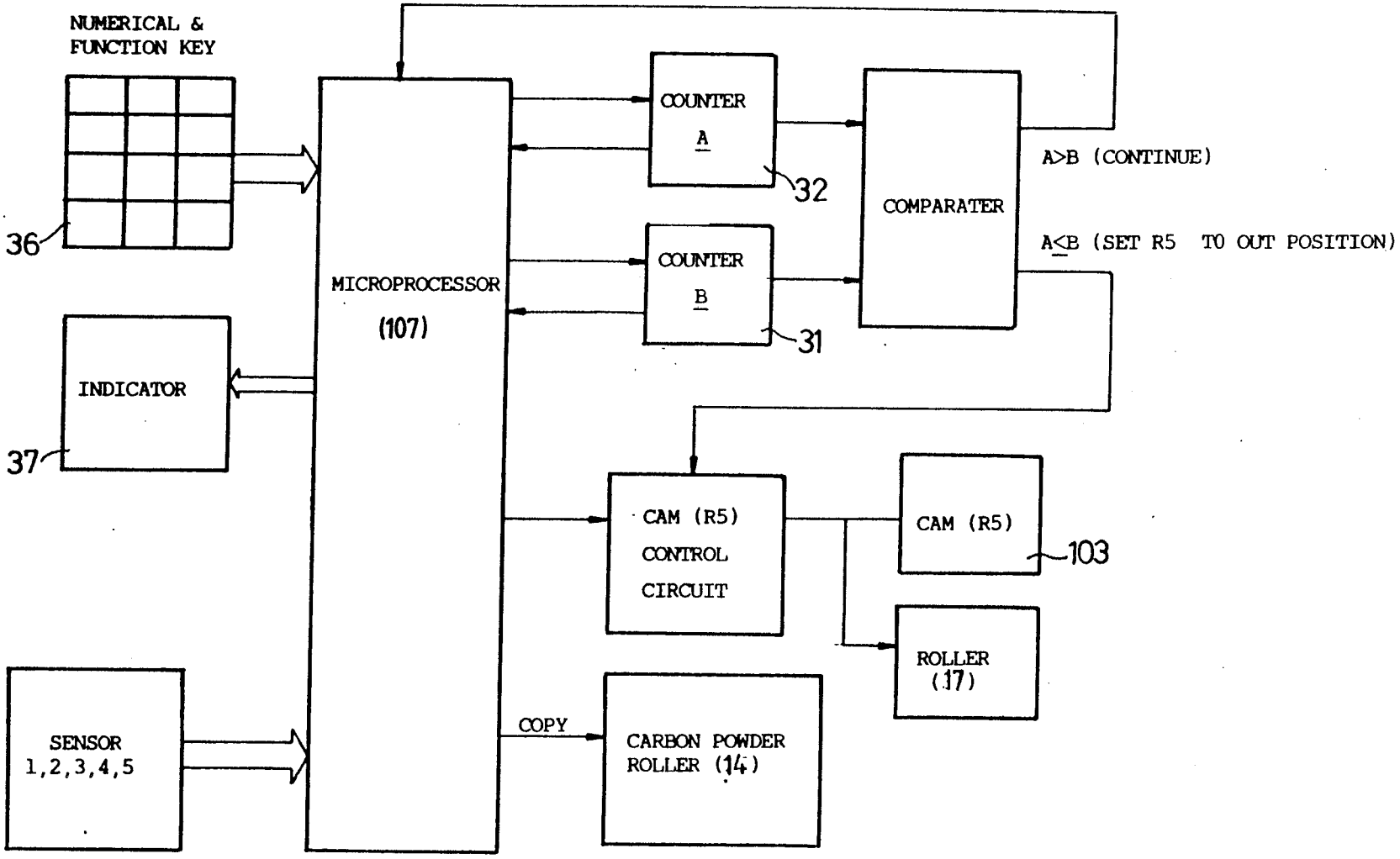
FIG. 3 is a control circuit flow chart thereof.

As shown in FIG. 2, the control panel 3 comprises a counter B 31, a counter A 32, a start key 33, a continue key 34, an indicator light 35, and numerical & function keys 36 (see FIG. 3).

Referring to FIG. 1, the first paper cassette 4 is for holding blank sheets of paper, the second paper cassette 5 is for holding the sheets of paper under duplication, and the third paper cassette 6 is for collecting completely duplicated sheets of paper.

The operation of the present invention is outlined hereinafter (with reference to FIG. 4).

A: Turn on the power (or input start code).

B: Place the book to copy on the exposure glass 2.

C: Set the start page according to the direction of the book bladed, (left-handed page or right-handed page) and input the data of the page number of the start page required in the counter B 31.

D: Input the data of the page number of the desired end page in the counter A 32 (In FIG. 2, it shows an example to duplicate a book from page 3 to page 15).

E: When it is determined to start copying from the left-handed pages, (i.e. counter-clockwise sequence of book blades) paper feeding from the paper cassette 4 is completed by the cam roller 11 (see FIG. 5*a*).

Figure 5B:
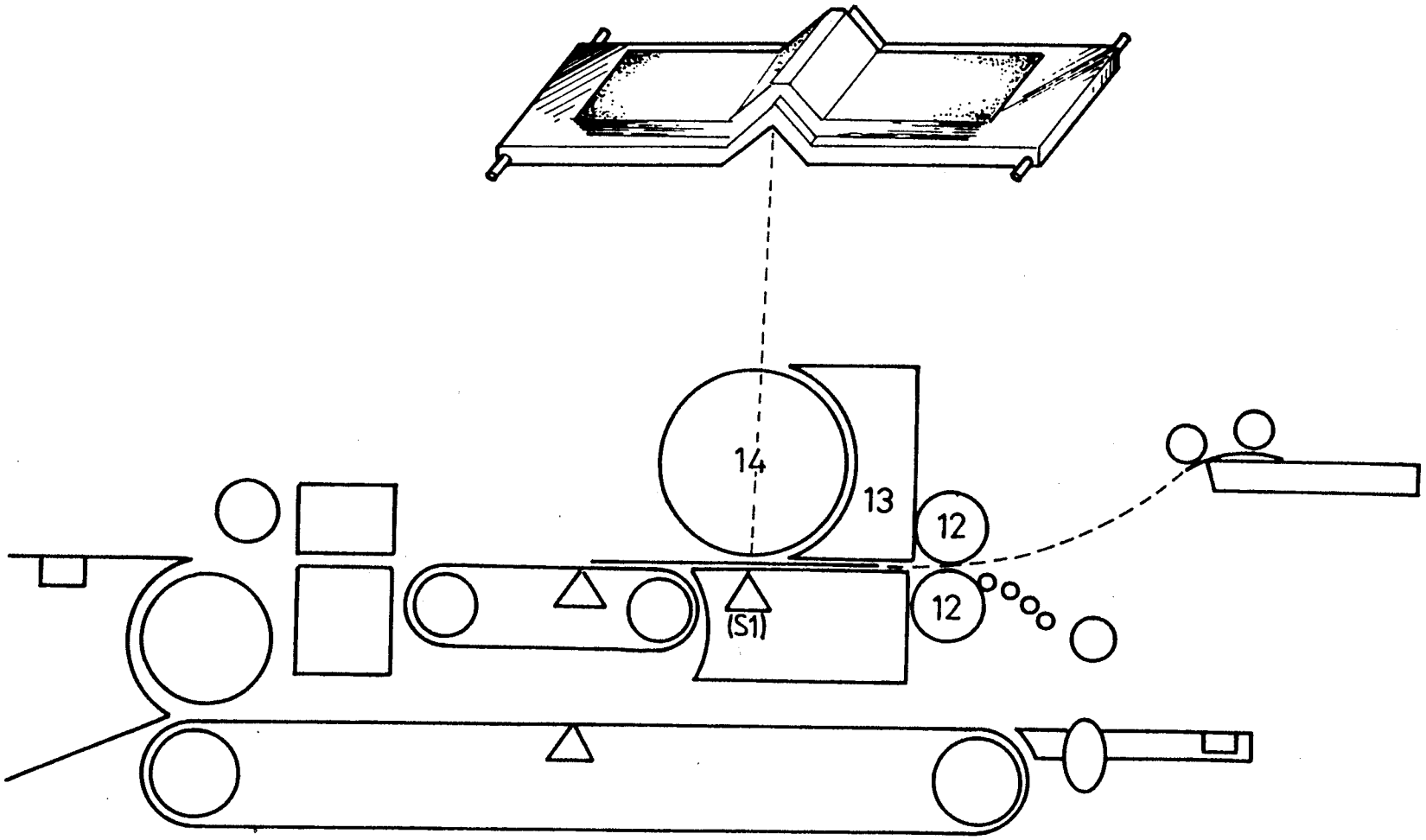

F: A blank sheet of paper is deleivered through the upper and lower rollers 12 to the toner cartridge 13 and the carbon power roller 14 to further contact the sensor S1 so that a duplication of the left-handed page is made, as shown in FIG. 5*b*, and the counter B 31 automatically adds one to its count.

Figure 5C:
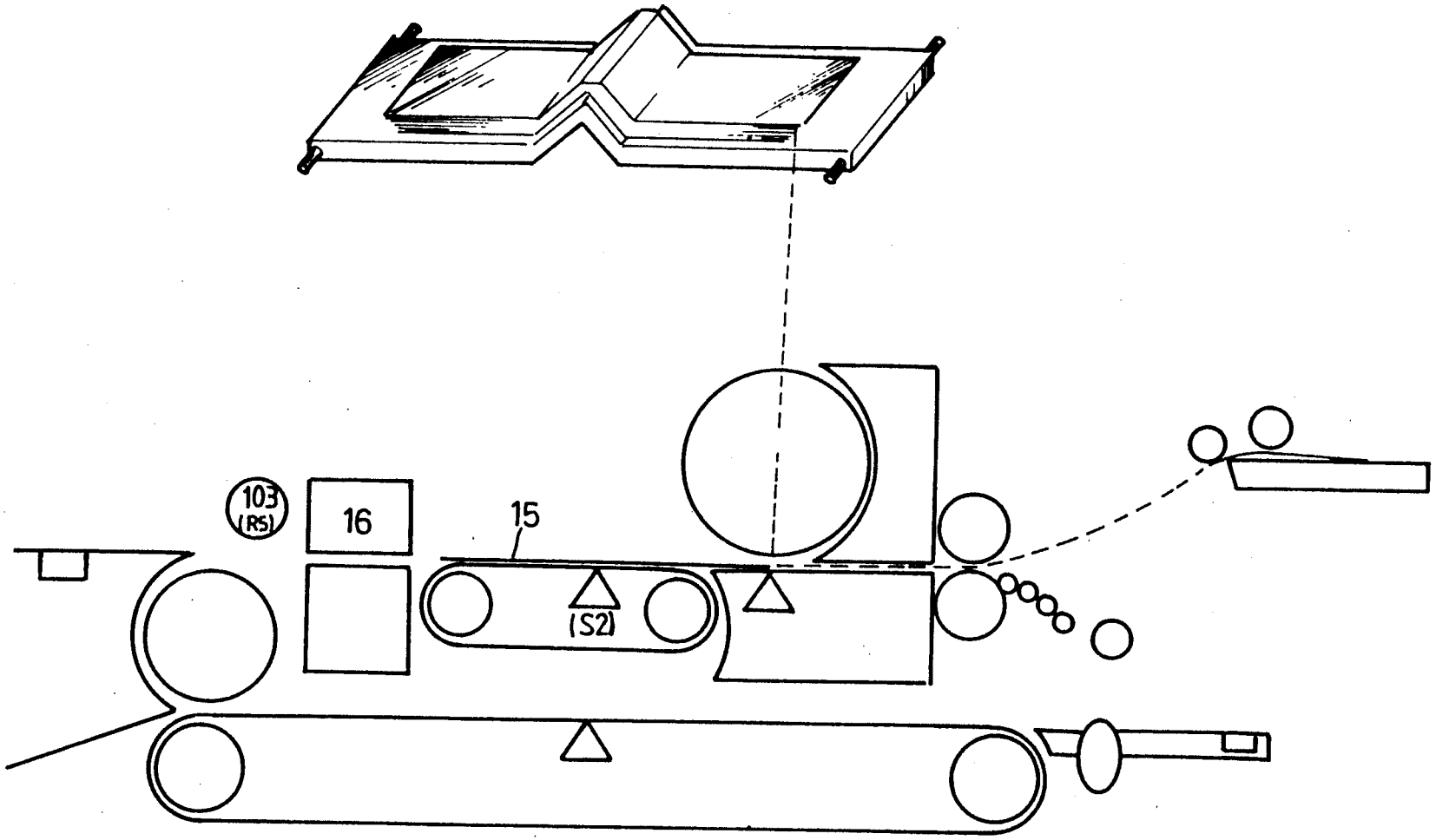

G: The right-handed page is automatically copied thereafter, as shown in FIG. 5*c*, and the counter B 31 simultaneously adds another one to its count.

Figure 5D:
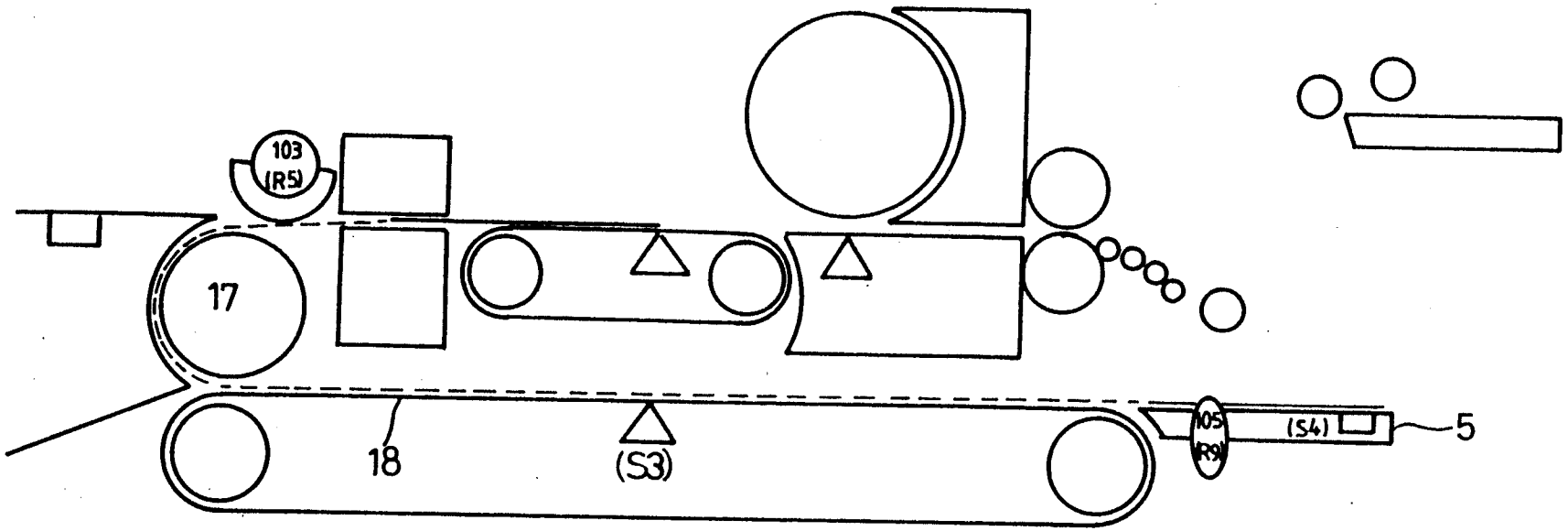

H: While the sheet of paper is continuously delivered to pass through the sensor S2 which is mounted on the belt conveyer 15, a corresponding signal is sent to the reactor R5 to control the cam 103 to turn its projecting edge through 180° angle, after image is fixed on the sheet of paper by the heat pressure device 16, so as to stop the forwarding of the duplicated sheet of paper (see FIG. 5*d*) and guide the duplicated sheet of paper to the roller 17 for turning through 180° angle. The duplicated sheet of paper is then sent to the return delivery belt conveyer 18 and the sensor S3 thereon simultaneously gives a signal to a microprocessor 107 (see FIG. 3) to control the programmed operation until the duplicated sheet of paper is delivered to the second paper cassette 5.

I: The detector S4 turns on the indicator light 35 to turn a page (This can be manually or through a page turn-over device as an alternation). As soon as the continue key 34 is pressed on after a page is changed, copying process is repeated.

Figure 5E:
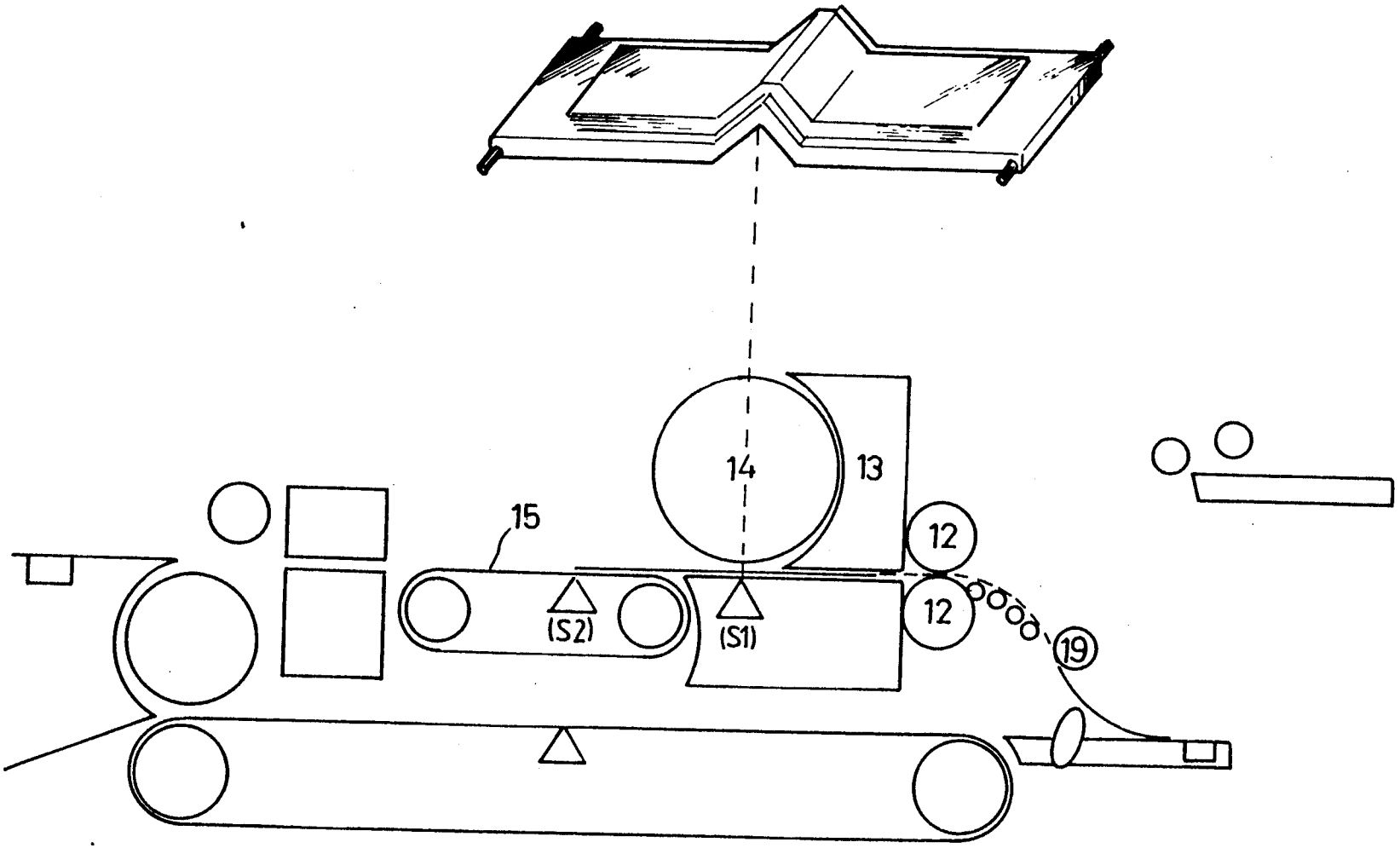
Figure 5F:
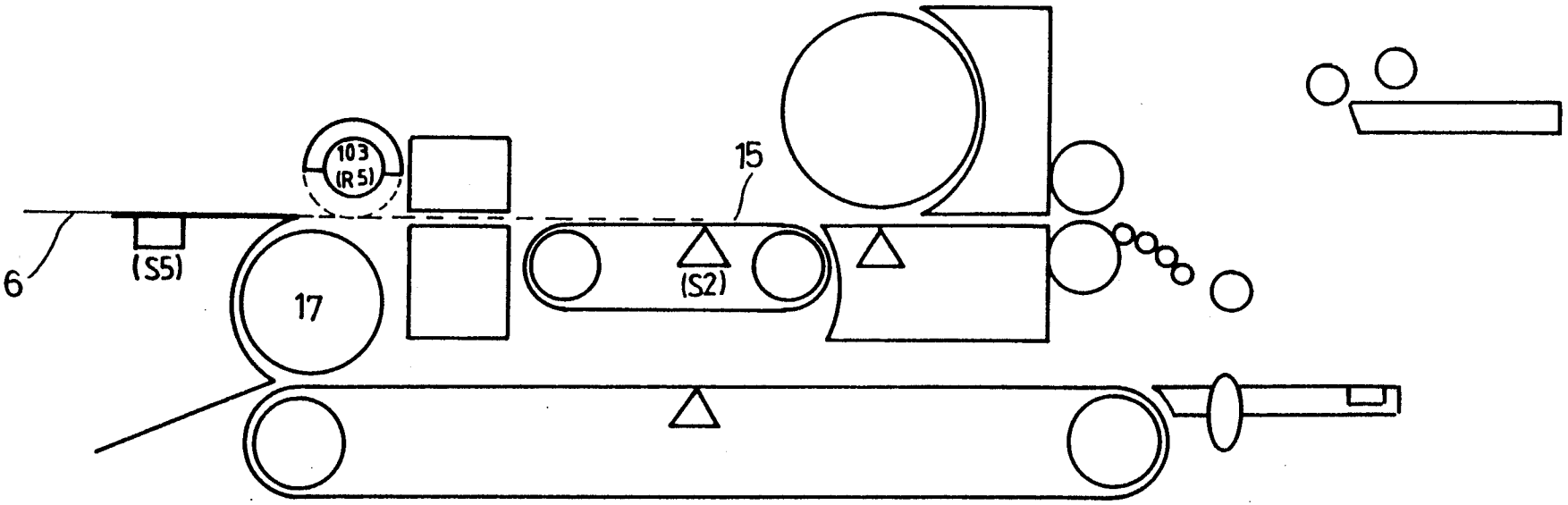

J: The sensor S4 simultaneously gives a signal to the reactor R9 to drive the stop wheel 105 to rotate counter-clockwise so as to guide a duplicated sheet of paper from the second paper cassette 5 to the guide roller 19 (see FIG. 5*e*), and the procedure of F is repeated. When a sheet of paper is detected by the sensor S2 of the belt conveyer 15 after a left-handed page is duplicated, a copying operation is stopped, the reactor R5 drives the cam 103 to rotate through 180° angle so that the projecting edge of the cam 103 is disposed upward at the top, as shown in FIG 5*f*. As soon as image is fixed, a well duplicated sheet of paper is delivered to the third paper cassette 6.

Figure 4:
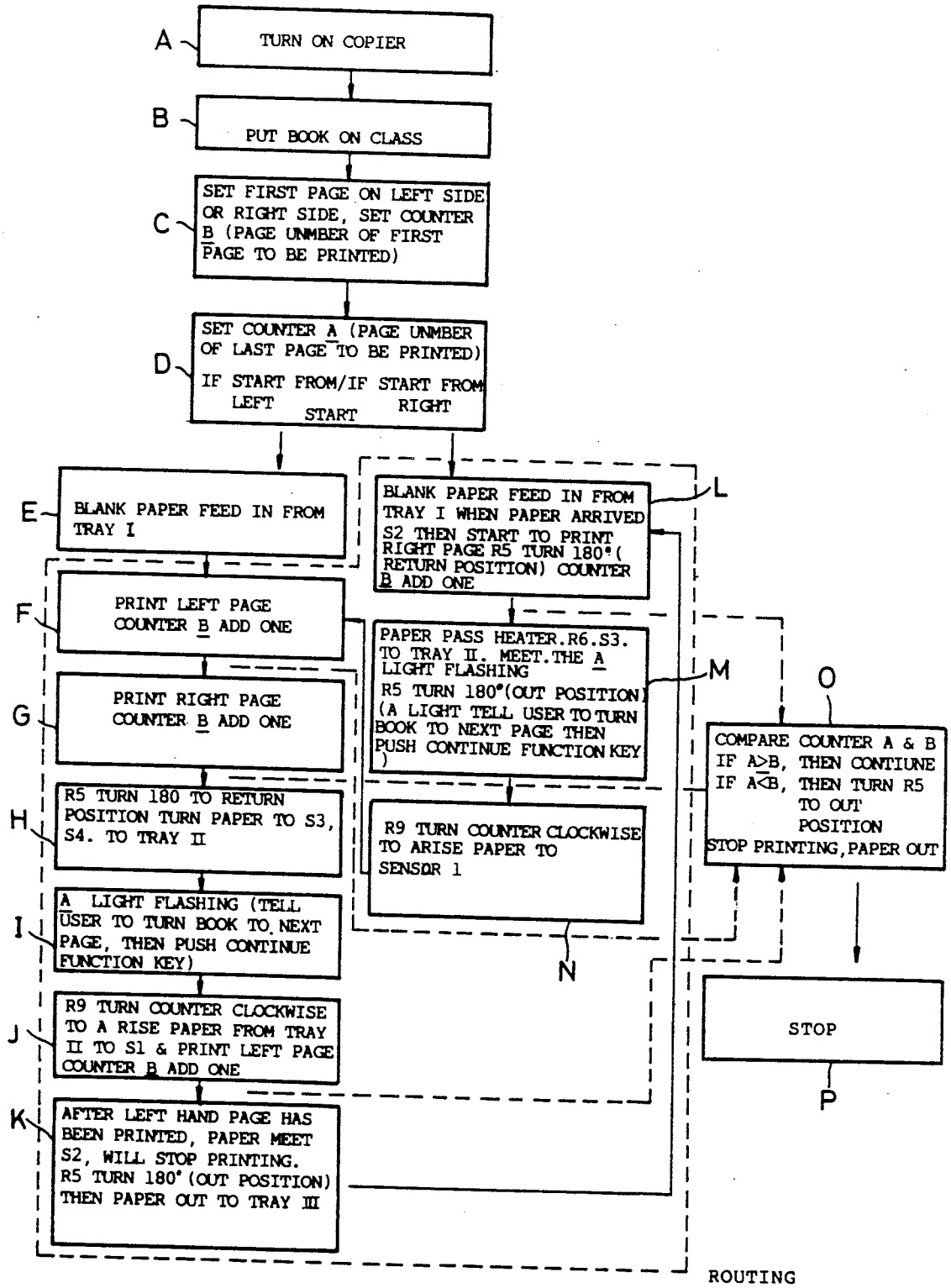
FIG. 4 is an operational flow chart thereof.
Figure 6:
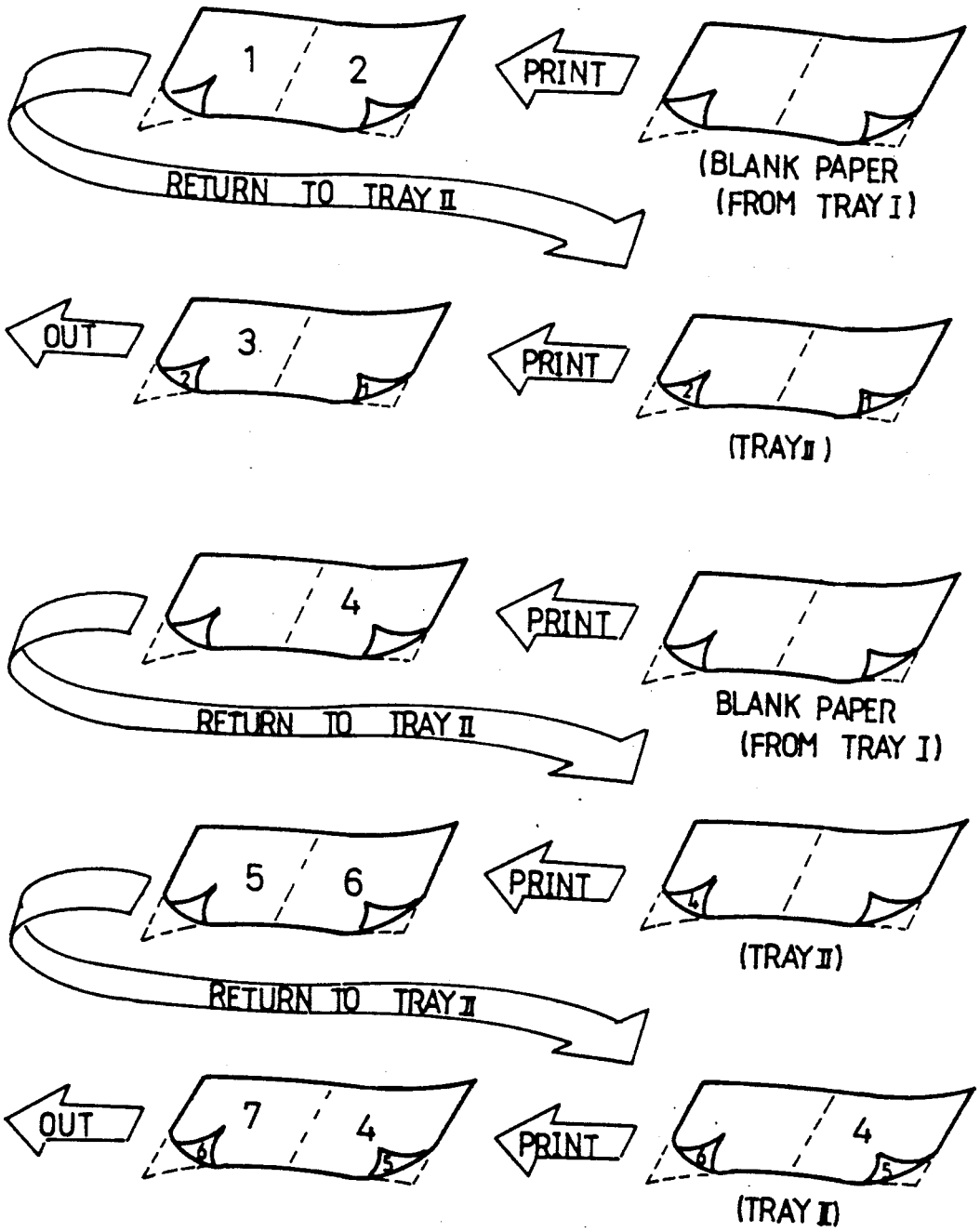
FIG. 6 is a flow chart illustrating an operation to start copying a book from left-handed pages.

The following copying procedures are performed in accordance with the flow chart illustrated in FIG. 4. As soon as the count in the counter B 31 exceeds that in the counter A 32, the reactor R5 automatically drives the cam 103 to turn its protecting edge upward. After all duplicated sheets of paper are completely collected in the third paper cassette 6, a whole book copying process is finished. With respect to page editing, please refer to FIG. 6.

The editing of pages from 1–7 is made by folding up a first sheet of pages 1–3 (with a blank page left) and a second sheet of pages 4–7 respectively and piling the folded first sheet of pages upon the other with the blank page of the folded first sheet disposed in the front. Thus, a book of duplicated sheets can be obtained.

Figure 7:
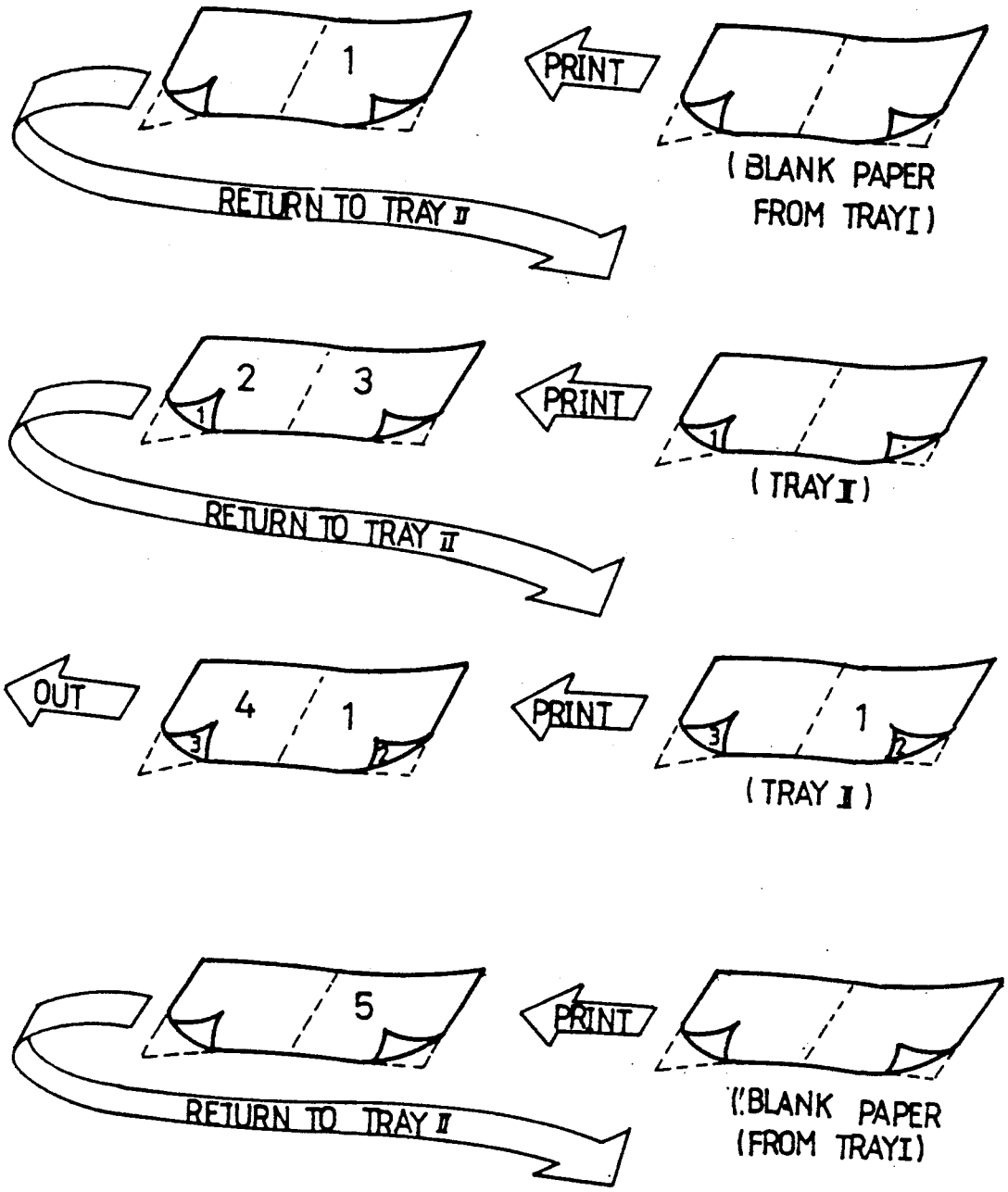
FIG. 7 is a flow chart illustrating an operation to start copying a book from right-handed pages.

When page editing starts from a right-handed page (i.e. clockwise sequence of book blades), it is made in accordance with the flow chart of FIG. 7. The copying procedures are performed according to the circulating flow illustrated in FIG. 4, and automatically stopped as soon as the count in the counter B 31 exceeds that in the counter A 32.

Referring to FIG. 3, there in illustrated is a control circuit flow chart according to the present invention. Input data is sent to the microprocessor 107 through the numerical & function key 36. During copying operation, the microprocessor 107 receives signals from the sensors 1, 2, 3, 4 and 5 to instruct a cam (R5) control circuit to control the positioning of the cam 103 and the roller 17 via the reactor R5. The comparison of the counter B 31 with counter A 32 is made through a comparator 107 so as to determine if to continue copying operation. All the operation procedures and the actions of the machine will be indicated through an indicator 37. Therefore, any machine trouble during copying can be immediately noticed.

Referring to FIG. 8*a*, the exposure glass 2 comprises an unitary, transverse wedge portion 21 in the middle to divide the exposure glass 2 into two equal parts, which transverse wedge 21 is designed to fit the curvature of the fold of a book so that the letters and drawings on the fold of either pages of a book can be accurately focused onto the lens of the copying camera.

The relative relation between the wedge portion 21 and the guide channels 24 of the exposure glass 2 and the projection through the exposure glass 2 are outlined hereinafter with reference to FIGS. 8*a–f* and FIG. 9.

Please refer first to FIGS 8*a* and 8*b*, in which the range between points A and B is equal to the range between points B and C and also equal to CM, ME, EF and FG. Except AB and FG, the projections through BC, CM, ME and EF are respectively deformed into a smaller image. From FIG. 8*b*, it can be clearly seen that BC° is smaller than BC, C°M° is smaller than CM, M°E° is smaller than ME, E°F' is smaller than EF, in which the difference in length between BC and BC' is equal to the length of C'C (see FIGS. 8*c–d*), the difference in length between BM and BM° is equal to the length of MM', and the rest can be inferred by analogy. Therefore, a displacement for compensation (see FIG. 9) is required while copying an image on the wedge portion so as to obtain a projection equal to the original image (see FIG. 8*e*). The guide channel 24 (see FIG. 10) is designed in such a manner that its vertical height is determined according to the length of MM° (h) and its width is determined according to the length of FF' (the total error of the slope, see FIG. 8*f*). Thus, the graphic track of the guide channel 24 is determined (see FIG. 10).

Figure 9:
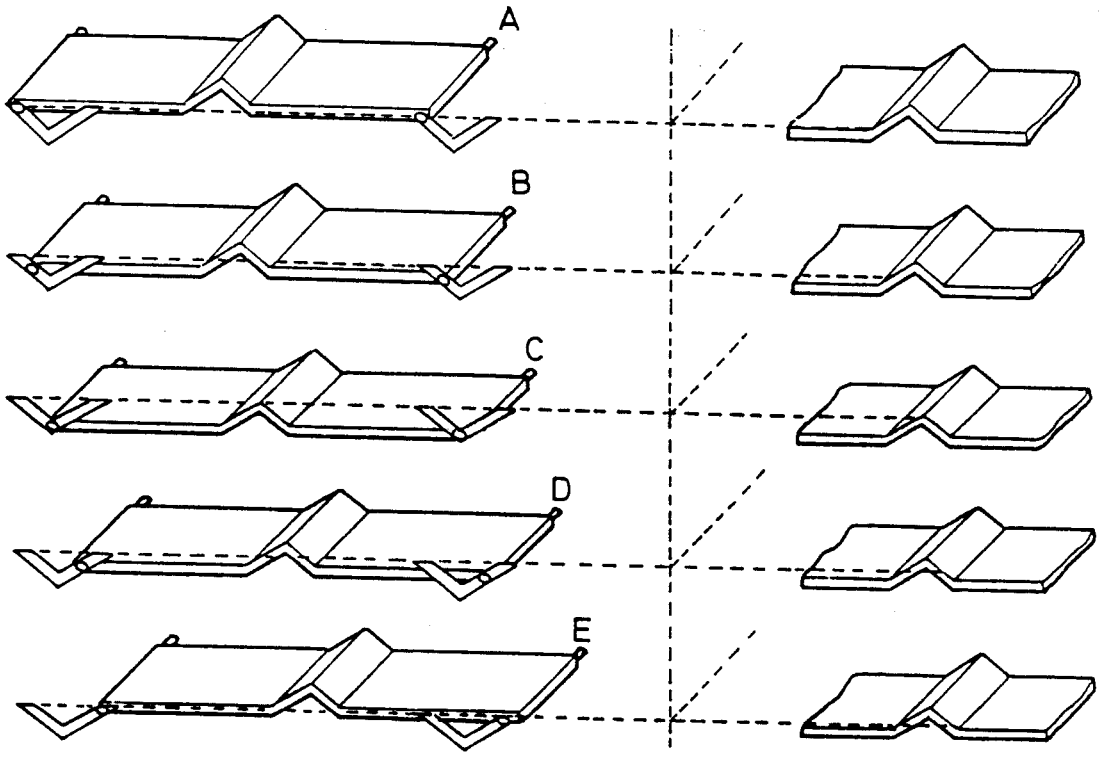
FIG. 9 is a schematic drawing illustrating a compensating process according to the present invention.

As described above, the graphic track of the guide channel 24 can be accurately calculated. While copying, an accurate duplication of an image on the wedge portion 21 of the exposure glass 2 can be obtained by means of the control of a servo motor 23 and the speed of the copying camera. As shown in FIG. 9, the dotted lines are the vertical axis, the motions from A through E are a continuous series, and the right-handed illustrations indicate the relative locations of projection during the displacement of the exposure glass 2 horizontally and vertically.

Referring to FIGS. 9 and 10 again, the mechanism which carries the exposure glass 2 to displace horizontally and vertically comprises a V-shaped guide channel 24 having set therein a rack 241 engaged with a link 22 through a steering gear 221, which link 22 is driven to rotate by a servo motor 23 through the control of a speed regulator 231.

When the servo motor 23 is turned on to rotate at a fixed speed, the steering gear 221 is carried to move along the rack 241 so as to carry the two side links 22 of the exposure glass 2 to move along the graphic track of the V-shaped guide channel 24 so as to compensate the deformation of projection through the wedge portion 21.

However, curvature of the fold of a book varies with thickness. The wedge portion 21 of the exposure 2 proposed to be controlled by an integrated circuit, comprises two equal parts pivotably connected together so that it can be pushed or pulled to adjust the angle of the wedge fitting the curvature of the fold of a book.

It is to be understood that the above drawings and description are for better understanding of the present invention and not intended as a definition of the limits and scope of the invention disclosed. Recognizing that various modifications been apparent the scope herein shall be defined in the claims as set forth hereinafter.

What is claimed is:

1. A book copying machine, comprising a housing having mounted thereon an exposure glass controlled to displace by a driving mechanism, and having set therein a camera system which comprises copying camera and a light source, a carbon powder feeding and image setting device which comprises a toner cartridge, a carbon powder roller and a heat pressure device for image setting, paper turn-over device, and a return delivery device, wherein:

said exposure glass comprises a wedge portion transversely made in the middle, said wedge portion being comprised of two opposite slopes projecting upward to divide said exposure glass into two equal parts;

said paper turn-over device comprises a reactor, a cam and a roller, said cam having a projecting edge controlled by said reactor to alternatively rotate through 180° angle to a position at the top or bottom;

said driving mechanism comprises a V-shaped guide channel having set therein a rack engaged with a driving link through a steering gear, said driving link being comprised of two opposite rods secured to said exposure glass at two opposite ends on its longer side and driven to rotate by a servo motor through the control of a speed regulator so as to drive said exposure glass to displace permitting the length of the projection of said light source on the upward slope on said wedge portion to be equal to the displacement of said exposure glass.

2. A book copying machine according to claim 1, wherein said wedge portion of said exposure glass is designed in shape according to the curvature of the fold of a book in an opened status.

3. A book copying machine according to claim 1, wherein said V-shaped guide channel has an inner track determined according to the projection through the upward slope of said wedge portion of said exposure glass.

4. A book copying machine according to claim 1, which performs a book copying operation according to the procedures of start-end page setting, start page side setting, receiving of blank sheet of paper, paper receiving and registration, paper turn-over, and paper return delivery; wherein:

said start-end page setting procedure is to input in a start page counter the data of the page number from which the duplication of a book is to be started and in an end page counter the data of the page number until which the duplication of a book is to be terminated so that book copying operation is automatically stopped as soon as the count in said start page counter exceeds that in said end page counter;

said start page side setting procedure is to first define the sequence to copy the book blades clockwise or counter-clockwise and then to set the start page from the first projection plane which is defined on the left half part of said exposure glass at the left side of said wedge portion or from the second projection plane which defined on the right half part of said exposure glass at the right side of said wedge portion;

after receipt of a blank sheet of paper, the blank sheet of paper is delivered inside said housing for duplication according to pre-determined page number setting, so as to first copy the second projection plane on the right side of said blank sheet of paper when clockwise sequence is pre-set, and then copy the first and the second projection planes on the opposite side of the sheet of paper after the sheet of paper is turned over and returned for next registration and finally copy the first projection plane on the right side of the sheet of paper on the start page face, and then, according to pre-determined page number setting to repeat the circulation of duplication process until the count in said start page counter exceeds that in said end page counter, and after completely duplicated copies having sent out the duplicated copies are separately folded up and piled up together to form a set of copies arranged in proper sequence;

after receipt of a blank sheet of paper, the blank sheet of paper is delivered inside said housing for duplication according to pre-determined page number setting, when counter-clockwise sequence is preset, and then copy the first and second projection planes on the left and right sides of the sheet of paper, after the sheet of paper is turned over and returned for next registration, and finally copy the first projection plane on the right side of the paper on the opposite face, and then, to repeat the circulation of duplication process of the clockwise sequence until the count in said start page counter exceeds that in said end page counter, and after completely duplicated copies having been sent out the duplicated copies are separately folded up and piled up together to form a set of copies properly arranged in sequence leaving the first page blank.

5. A book copying machine according to claim 4, wherein said paper turn-over procedure is to turn the duplicated side of a sheet of paper upward and the opposite side of such a sheet of paper downward.

6. A book copying machine according to claim 4, wherein said return delivery procedure is to send the sheet of paper which has been turned over to the paper receiving and registration device for next copying circulation operation.

* * * * *